US007201467B2

(12) United States Patent
Ros et al.

(10) Patent No.: US 7,201,467 B2
(45) Date of Patent: Apr. 10, 2007

(54) HARDCOPY SERVICING APPARATUS

(75) Inventors: Francesc Ros, Sant Vicent de Montalt (ES); Marc Jansa, Barcelona (ES); Macia Sole, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 369 days.

(21) Appl. No.: 10/830,135

(22) Filed: Apr. 23, 2004

(65) Prior Publication Data

US 2004/0263569 A1 Dec. 30, 2004

(30) Foreign Application Priority Data

Apr. 25, 2003 (EP) ..... 03101151

(51) Int. Cl.
*B41J 23/00* (2006.01)

(52) U.S. Cl. ..... 347/37; 347/86; 347/108

(58) Field of Classification Search ..... 347/37
See application file for complete search history.

(56) References Cited

U.S. PATENT DOCUMENTS 4,683,481 A 7/1987 Johnson
5,278,584 A 1/1994 Keefe et al.
6,328,415 B1 * 12/2001 Norton et al. ..... 347/37
6,416,166 B1 7/2002 Robinson et al.
6,955,422 B2 * 10/2005 Miyazawa et al. ..... 347/86

FOREIGN PATENT DOCUMENTS

| | | |
|---|---|---|
| EP | 0 799 702 | 9/2003 |
| JP | 11-078043 | 3/1999 |
| JP | 200272097 | 10/2000 |

* cited by examiner

*Primary Examiner*—Manish S. Shah
*Assistant Examiner*—Brian J. Goldberg
(74) *Attorney, Agent, or Firm*—Foley & Lardner LLP

(57) ABSTRACT

An ink reservoir adaptor for use in a printing device, comprising a reservoir supporting element movable relative to the adaptor between first and second positions, the supporting element being arranged in the first position to receive a reservoir such that an interface associated with the reservoir is located in a predetermined position relative to the supporting element, the supporting element being further arranged, when moved to the second position, to bring the interface to a predetermined position relative to the adaptor.

13 Claims, 11 Drawing Sheets

HARDCOPY SERVICING APPARATUS

FIELD OF THE INVENTION

The present invention relates generally to hardcopy devices, particularly but not exclusively to inkjet printers and to apparatus for servicing such devices.

BACKGROUND TO THE INVENTION

As is well known in the art, conventional inkjet printers generally employ one or more inkjet cartridges, often called "pens", which eject drops of ink onto a page or sheet of print media. For instance, two earlier thermal ink ejection mechanisms are shown in U.S. Pat. Nos. 5,278,584 and 4,683,481, both assigned to Hewlett-Packard Company. The pens are usually mounted on a carriage, which is arranged to scan across a scan axis relative to a sheet of print media as the pens print a series of individual drops of ink on the print media. The series of drops collectively form a band or "swath" of an image, such as a picture, chart or text. Between scans, the print medium is advanced relative to the scan axis. In this manner, an image may be incrementally printed.

Generally, ink is provided in replaceable ink containers or supplies, which are designed to interface with the printer. Such ink supplies are sometimes provided in a range of different volumes. In this way a user may select the volume of an ink supply in dependence upon the expected usage rate. If the volume is too small, it will require frequent replacement. If, on the other hand, the volume is too large, it may reside in the printer for a period of time that exceeds the shelf life of the ink. Thus, in the case of a high throughput inkjet printer, for example, suitable ink supplies may be available in a range of volumes such as 0.2 to 1.0 liters.

In printer systems which are adapted to be used with varying sizes of ink containers, it is often viewed as desirable, in order to save space and expense, to ensure that the same ink container interface associated with the printer system may be used with various differently sized ink containers. In order to allow both small and large volume ink containers to be installed in a printer system, it is known to use a spacer, or interconnecting part to facilitate the installation of the small volume ink containers. In such systems, however, the user must usually buy one or more interconnecting parts. Such interconnecting parts represent an inconvenience for many users, since they may be difficult to use. Furthermore, such interconnecting parts must be stored while they are not being used and during such times they may be lost or damaged.

Another known way of supplying such ink containers or supplies having a range of different volumes is to market a single size of ink supply container but filled with ink to varying degrees. In this manner, high volume users may purchase fully filled ink supply containers and lower volume users may purchase partially filled ink supply containers. In this manner, each user may purchase the volume of ink that he or she desires. However, such an approach is relatively wasteful both in terms of the material that is used to manufacture the ink supply containers that are only partially filled and in terms of space that is required to store them.

It would therefore be desirable to provide a hardcopy device, or servicing apparatus for use in a hardcopy device, which addresses one or more problems encountered in the prior art.

SUMMARY OF THE INVENTION

According to one aspect of the present invention there is provided an ink reservoir adaptor for use in a hardcopy device, comprising a reservoir supporting element movable relative to the adaptor between first and second positions, the supporting element being arranged in the first position to receive a reservoir, the supporting element being further arranged, when moved to the second position, to bring an interface associated with the reservoir into a predetermined position relative to the adaptor.

Advantageously, embodiments of the present invention allow an ink reservoir to be easily installed for use. A user may locate an ink reservoir relative to the supporting element whilst the element is in the first position, and then correctly install the reservoir by moving the supporting element to the second position. Thus, any required connections between the reservoir and the printer, such as electrical connections or fluid connections for ink supply and pressurisation of the reservoir, may be made by the simple procedure of moving the supporting element to the second position. In one embodiment, the supporting element is a slider or drawer-like apparatus, which may be moved from the first position to the second position simply by being pushed or manually inserted by a user along a predetermined path.

Such embodiments may obviate the need for the user to carry out a conventional installation operation in a confined space, which often requires significant manual dexterity. Such embodiments need not require modification of the interface between the printer or hardcopy device and the reservoir; thus allowing backward compatibility with many existing printer components and reservoirs.

In certain embodiments of the invention the supporting element may be adapted to support ink reservoirs of different sizes. In this manner, a user may locate any one of a range of different sized ink reservoirs on the supporting element, when it is located in the first position. The supporting element and the reservoirs may have mutually engaging features that ensure that each size of reservoir is located in a predetermined position relative to the supporting element. This may help the user to correctly locate each size of reservoir relative to the supporting element in a simple and intuitive manner. This feature may be used to ensure that the reservoirs will be correctly located relative to the adaptor, and thus the printer, when the supporting element is moved to the second position. In this manner, connection between the reservoir and the printer may be correctly established. In alternative embodiments, visual guides may instead be used to illustrate where or how reservoirs of given sizes should be located relative to the supporting element.

In one such embodiment of the invention, the supporting element is arranged such that the interface of each size of ink reservoir is located in the same place relative to the supporting element. In this way, the supporting element may be moved between substantially the same first and second positions to correctly connect or install each of a range of differently sized reservoirs in a printer. Thus, this may be made to be a very intuitive operation, easily understood and implemented by the user.

Furthermore, in such embodiments the design of the interface between the ink reservoir(s) and the printer may conveniently be conventional and/or independent of the volume of the supply. Thus, conventional ink reservoirs may be used, ensuring backward compatibility with existing reservoir designs. This allows conventional features to be employed. These may include mechanical lockouts that control the type of reservoir, in terms of ink type or colour for example that may be installed in a given bay; and, thus used in a particular printhead. Additionally, such embodiments do not require the user to buy or use further interconnecting parts or interfaces in order to allow differently sized reservoirs to be correctly installed in a printer.

In certain embodiments of the invention, the adaptor has a reservoir housing or bay, with the supporting element being arranged to be located substantially outside the reservoir bay in the first position and to be located substantially inside the reservoir bay in the second position. In this manner, a reservoir may be easily mounted on the supporting element in the first position. Furthermore, a reservoir may be located with in the bay when the supporting element is located in the second position. This gives rise to the advantage that the bay may provide support for the reservoir. Conventionally, large ink reservoirs may be pressurised to 6 psi or more to facilitate the supply of ink. This may have the effect of deforming the reservoirs if they aren't suitably supported, or don't have sufficient rigidity as may be the case with large ink supplies. In this manner, in embodiments of the present invention a reservoir may be made comparatively inexpensively without a high degree of intrinsic rigidity and yet be pressurised without the risk of the reservoir walls becoming distorted.

Thus, embodiments of the present invention may be manufactured as inexpensive plastic parts and may provide flexibility to users who may use different volumes of ink supply in an easy, interchangeable manner. Furthermore, they may provide flexibility to hardcopy manufacturers by allowing different supply volumes to be usable in a given printer model or indeed the same ink supply system to be used in different printers.

The present invention also extends to corresponding hardcopy devices.

BRIEF DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE BEST MODE FOR CARRYING OUT THE INVENTION

There will now be described examples of the best mode contemplated by the inventors for carrying out the invention.

First Embodiment

Figure 1:
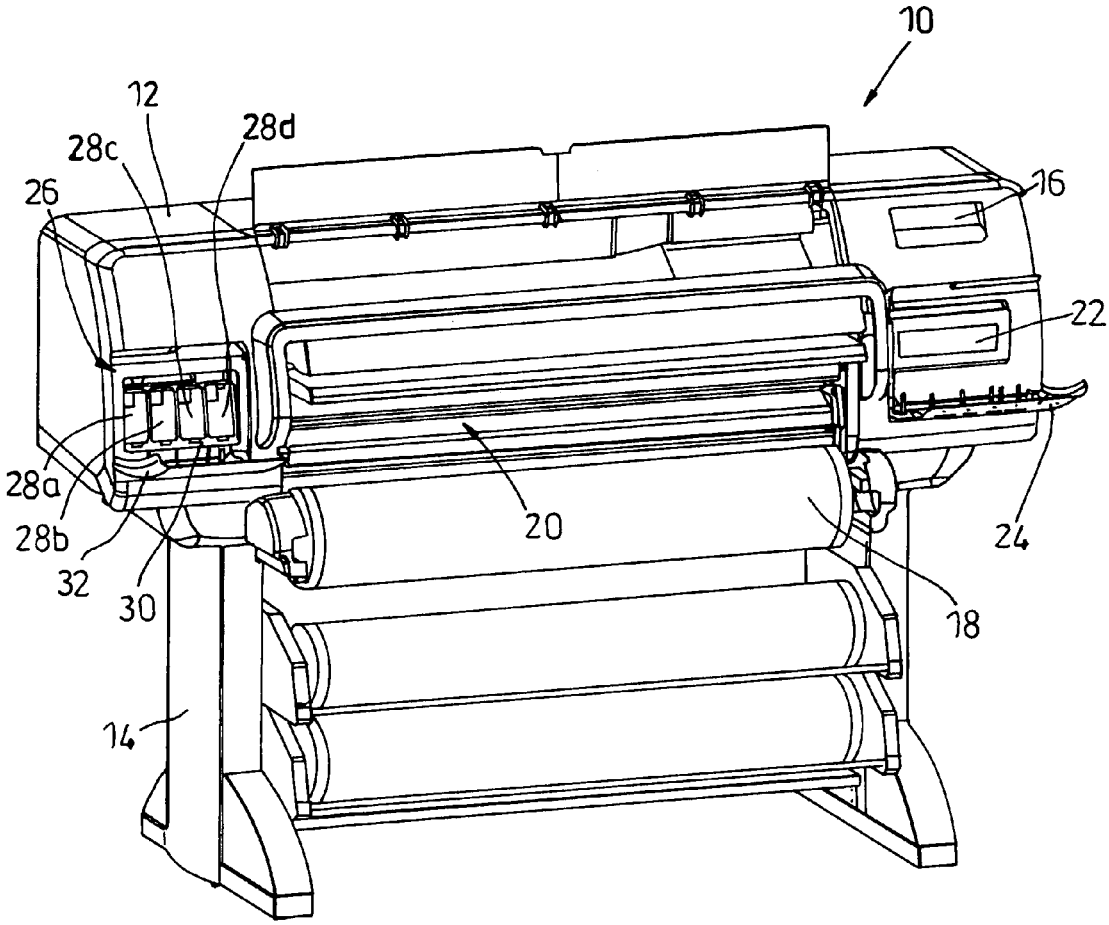
FIG. 1 is a perspective view of an inkjet printer in accordance with a first embodiment of the present invention.

Referring to FIG. 1, an embodiment of an inkjet printer 10 according to the present embodiment is shown. The printer 10 may be used for printing conventional engineering and architectural drawings, as well as high quality poster-sized images, and the like, in an industrial, office, home or other environment.

While it is apparent that printers may vary from model to model, in the present example, the printer 10 has a printer body housed in a casing 12 and supported on a pair of leg assemblies 14. The printer 10 may be operated through user commands, input through a key-pad and status display portion 16, located on the exterior of the casing 12. Alternatively, the printer may operate in response to instructions received from a host device, such as a personal computer or a computer aided drafting (CAD) computer system (not shown).

The printer has a conventional print media handling system (not shown) that may be used to advance a sheet of print media in the form of pre-cut sheets, or from a roll 18 through the print zone 20 along the Y axis in a conventional manner. In the print zone 20 the media sheet receives ink from one or more conventional inkjet cartridges (not shown); often termed "pens" in the art. In the present embodiment, four ink-jet cartridges are supported on a scanning carriage (not shown), which is arranged to travel back and forth, in the X axis, across the print zone. In the present embodiment, each of the four inkjet cartridges is arranged to print a different colour ink: black; cyan; magenta; and, yellow respectively.

A conventional inkjet cartridge servicing station 22 is located at the right hand end of the printer body 12, as viewed in the figure. The user may gain access to the servicing region 20 via an access panel 24, which is illustrated in the open position in the figure.

The printer 10 uses an "off-axis" ink delivery system. In an off-axis system, the pens may be replenished by ink conveyed through a conventional flexible tubing system (not shown) from stationary main reservoirs, which are located "off-axis" from the path of printhead travel. In this manner, only a small ink supply is propelled by carriage across the print zone. The printer 10 has an ink supply region 26, located at the left hand end of the printer body 12, as viewed in the figure. As can be seen from the figure, four stationary reservoirs 28*a–d* are located in the ink supply region 26. In the present embodiment, the four stationary reservoirs 28*a–d* supply black, cyan, magenta, and yellow ink respectively to a corresponding cartridge.

As can be seen from the figure, and as is described in more detail below, the stationary reservoirs 28*a–d* are removeably supported in an adaptor unit 30, which is itself supported in the ink supply region 26 of the printer 10. In this manner, when one of the reservoirs 28*a–d* runs out of ink, the user may replace it with a new or replacement reservoir. The user may gain access to the reservoirs via an access panel 32, which is illustrated in the open position in the figure.

Figure 2A:
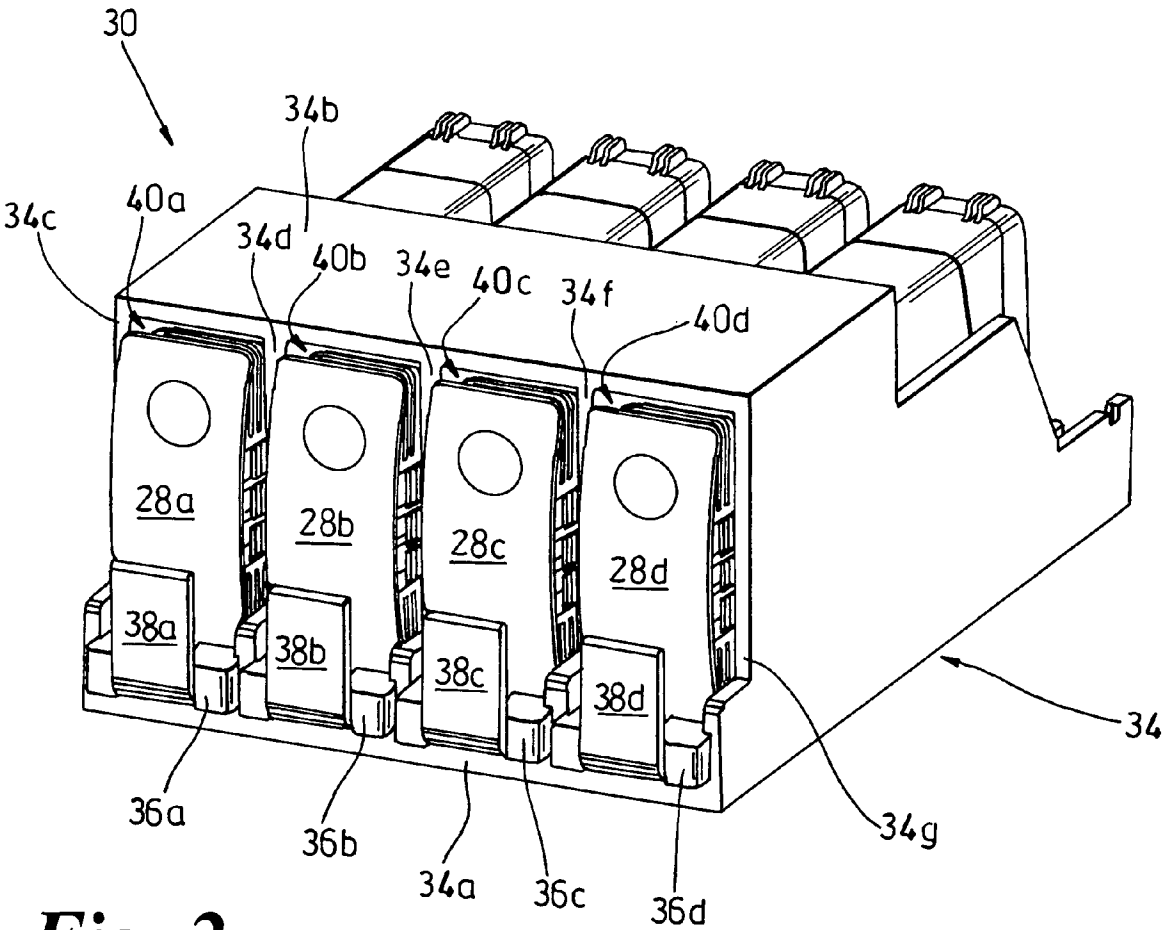
FIG. 2*a* is a perspective schematic view of the adaptor assembly illustrated in FIG. 1, with high volume reservoirs in place.

Referring now to FIG. 2*a*, a perspective view of the adaptor unit 30 is shown, removed from the printer 10. In practice, the adaptor unit 30 may be either removeably, or non-removeably mounted in the printer 10. The adaptor unit 30 has a housing 34, which may be made from any suitable material. In the present embodiment, this is a single-piece, plastic, injection moulded part. The housing 34 has four external walls forming a box structure. As represented in the figure, the external walls include an upper surface 34*b*, a lower surface 34*a*, which are arranged parallel to one another, and two side walls 34*c* and 34*g*. The side walls 34*c* and 34*g* are also arranged parallel to one another, spaced apart in the X axis, and are each connected to both the upper and lower surfaces 34*a* and 34*b*. Three further walls 34*d*, 34*e* and 34*f* are located between the two side walls 34*c* and 34*g*. The walls 34*d*, 34*d* and 34*f* are arranged parallel to the side walls 34*c* and 34*g* and, like the side walls 34*c* and 34*g*, are arranged to interconnect the upper and lower surfaces 34*a* and 34*b*. In this manner, four bays, referenced 40*a–d*, are formed between the upper and lower surfaces and adjacent pairs of walls 34*c–g*. The front and rear of each of the bays, in the Y axis, is open. In this manner, reservoirs may be inserted into the bays from one side and fluid and electrical connections may be made between the reservoirs and the printer at the other, as is described below.

As can be seen from the FIG. 2*a*, a single conventional reservoir 28*a–d* is located in each bay 40*a–d*. Associated with each bay is a slider assembly. Each slider assembly has a slider element 36*a–d* and connected to it a slider release tab 38*a–d*. Each slider element 36*a–d* is arranged to slide in and out of its corresponding bay 40*a–d* along the Y axis. Each slider element is constrained to follow grooves (not shown) located in the walls 34*c–*34*g*, located on either side of that slider element. In the present embodiment, the slider elements are manufactured out of any suitable plastic material. In this manner it may be ensured that the slider elements 36*a–d* slide freely relative to the housing 34 without the need for special bearings or lubrication.

As is described below, the slider elements are arranged to support and locate the reservoirs correctly in their respective bays, facilitating the installation and removal of reservoirs designed for use in conjunction with the printer of the present embodiment.

In the present embodiment, each of the bays 40*a–d* has the same internal form and dimensions. In the present embodiment, the bays 40*a–d* are sized in order to allow a selected models of ink reservoir to be inserted into the bays along the Y axis in a loose sliding fit. In the present embodiment, as is conventional in many inkjet printers, the ink supply reservoirs are pressurised in use in order to facilitate the transport of ink from the reservoirs to the printheads. Thus, in the present embodiment, the size of the bays is chosen to permit easy installation of the reservoirs in the bays whilst preventing the reservoirs from expanding overly, particularly in a direction perpendicular to the Y axis, when pressurised. In this manner, the structural rigidity required to resist the expansion of the reservoirs may be incorporated into the housing 34 instead of the reservoirs themselves. Thus, the cost and weight of the replaceable reservoirs may be reduced.

The reservoirs 28*a–d* shown in FIG. 2*a*, may be termed in the present embodiment "high volume reservoirs". In the figure, the reservoirs 28*a–d* are each illustrated in their installed position. By this, it is meant that they are correctly mounted in the adaptor unit for use in printing. In this position, such high volume reservoirs may extend slightly in the positive Y axis direction from the walls 34*c–g* of the housing 34.

Figure 2B:
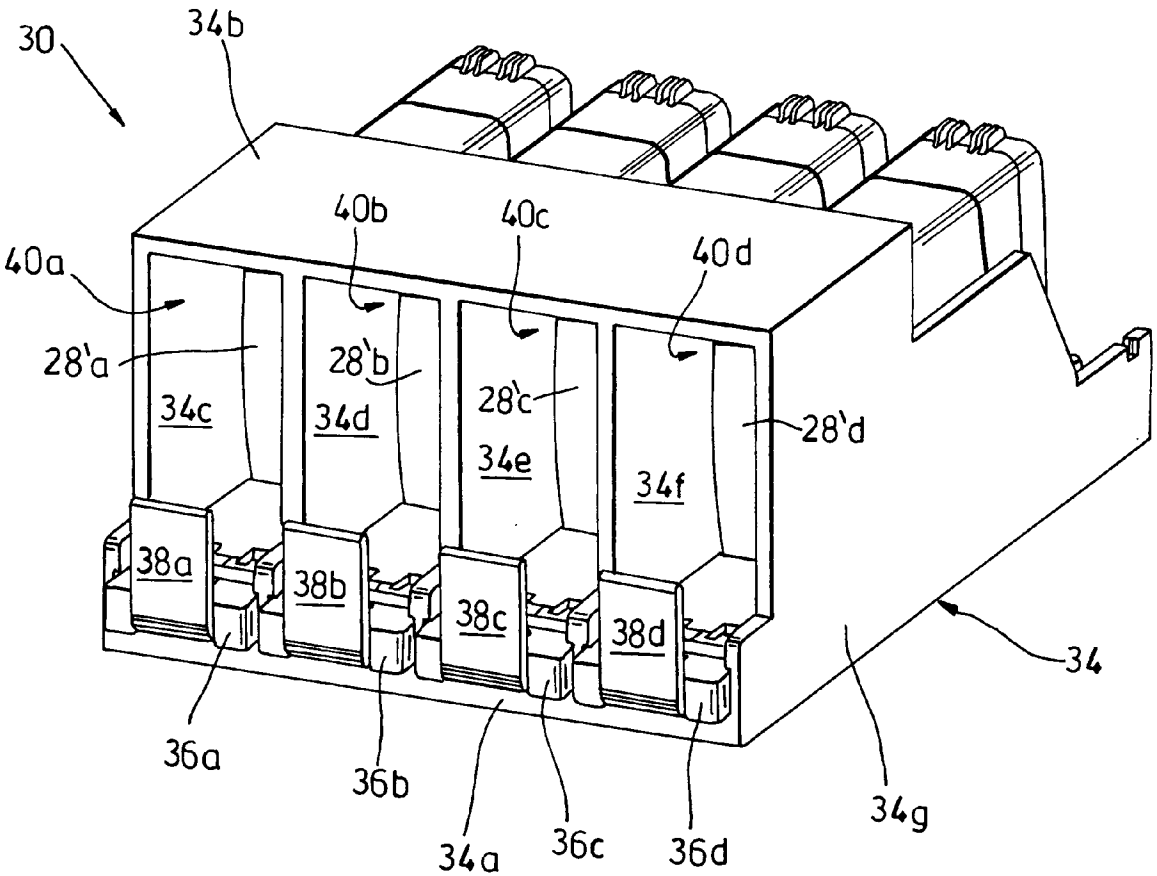
FIGS. 2*b* and *c* show the adaptor assembly as illustrated in FIG. 1, with low volume reservoirs and a mixture of high and low volume reservoirs, respectively, in place.

Referring now to FIG. 2*b*, a similar view of the adaptor unit 30 to that shown in FIG. 2*a* is illustrated. However, in FIG. 2*b*, a conventional "low volume reservoirs" 28*a'–d'* is shown in its installed position in each of the bays 40*a–d*. As can be seen from the figure, the low volume reservoirs 28*a'–d'* extend less far in the positive Y axis direction relative to the housing 34 when in the installed position than do the high volume reservoirs 28*a–d*.

Figure 3:
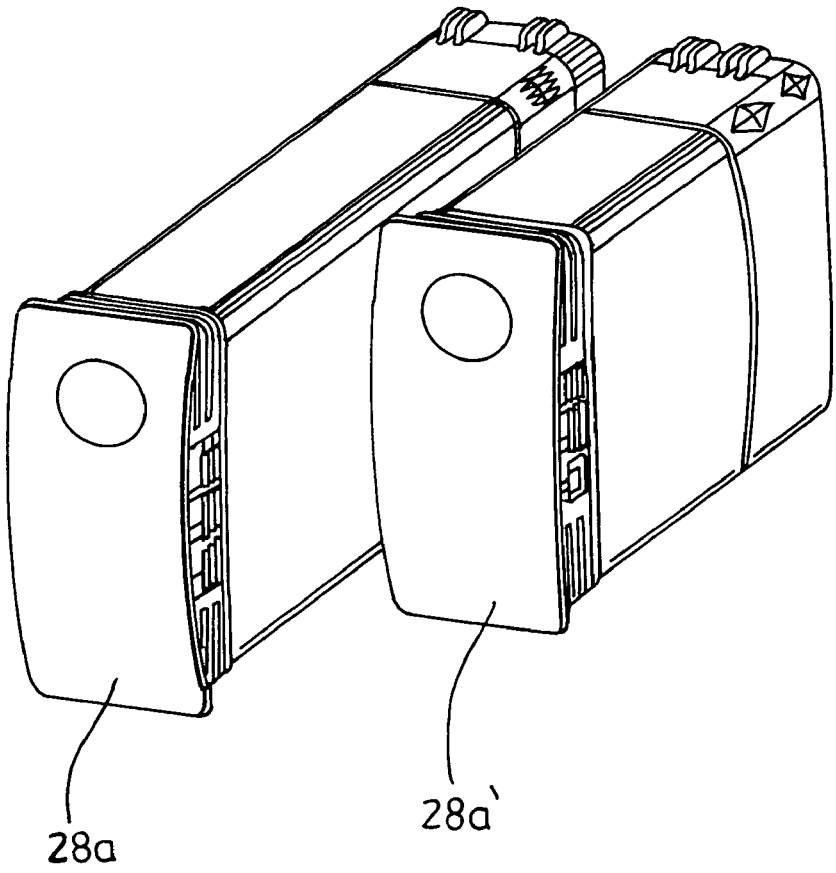
Fig. 3 (PRIOR ART)
FIG. 3 is a perspective view of conventional high and low volume ink reservoirs.

In FIG. 3, a perspective view of an exemplary high volume reservoir 28*a* and an exemplary low volume reservoir 28*a'* are shown. Although not shown in the figure, both types of reservoir 28*a* and 28*a'* have the same type of interface for connection to the printer. As can be seen from the figure, the dimensions of the two types of reservoir are the same, except for their lengths in the Y direction, as indicated in the figure. In this manner the size and shape of the bays in the present embodiment is also suitable for easy installation of the low volume reservoirs. Furthermore, the bays prevent the low volume reservoirs from expanding overly when pressurised in the same manner as described above with regard to the high volume reservoirs.

Figure 2C:
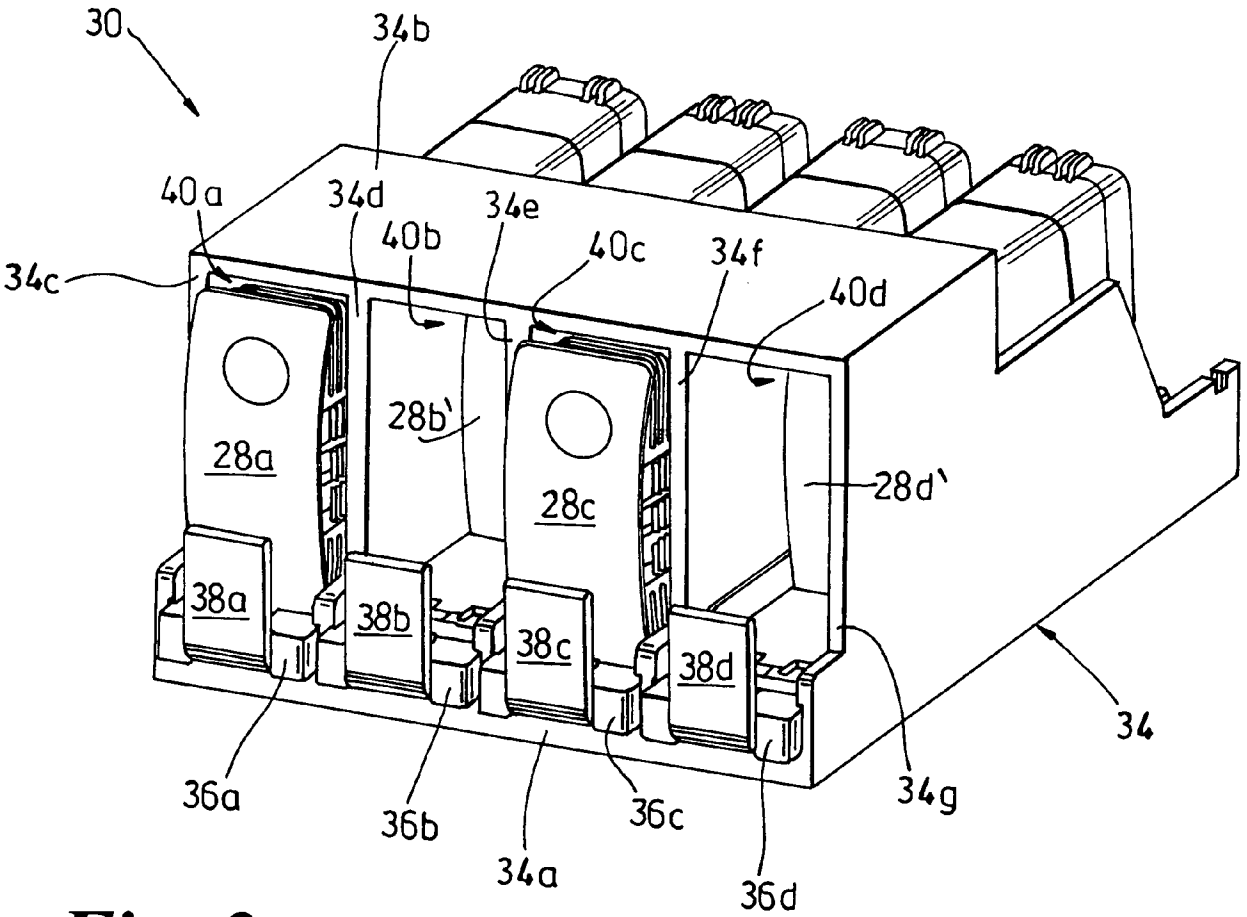

It will thus be appreciated that in the present embodiment a high or low volume reservoir may be installed in any of the bays 40*a–d*. Furthermore, one or more low volume reservoirs may be installed in the adaptor unit 30 at the same time as one or more high volume reservoirs. An example of this is illustrated in FIG. 2*c*. Here, two low volume reservoirs 28*b'* and 28*d'* are shown in their installed positions in bays 40*b* and 40*d*, respectively, and two high volume reservoirs 28*a* and 28*c* are shown in their installed positions in bays 40*a* and 40*c*, respectively.

Figure 4A:
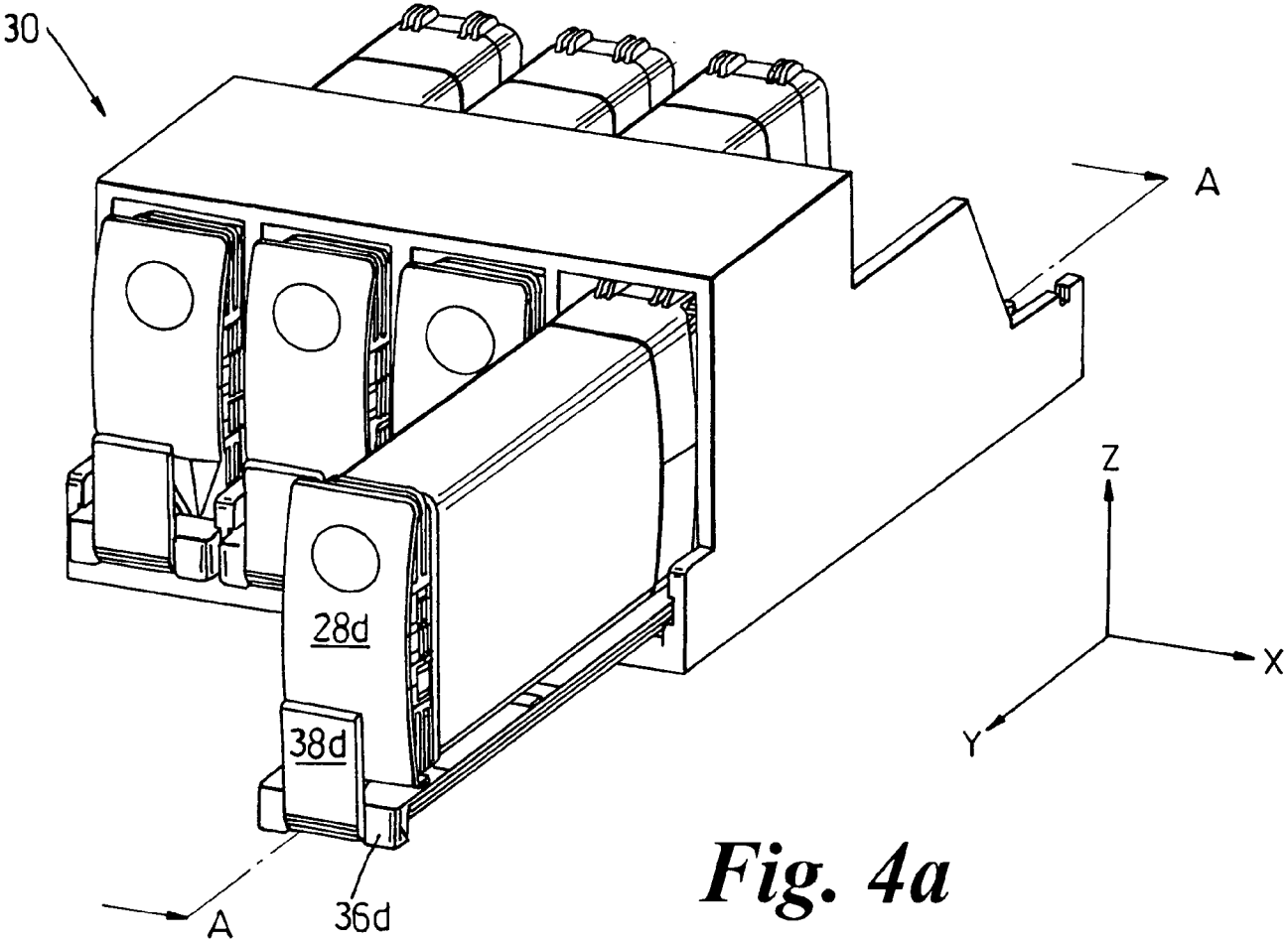
FIGS. 4*a* and 4*b* show the adaptor and ink reservoirs corresponding to FIGS. 2*a* and 2*b* respectively, with one of the sliders in its open position in each case.

Referring now to FIG. 4*a*, a view similar to that shown in FIG. 2*a*, of the adaptor unit 30 with high volume reservoirs is illustrated. However, in FIG. 4*a*, the slider 36*d* is illustrated in its open position, with the reservoir 28*d* correctly located on the slider 36*d*. That is to say, that the slider 36*d* is extended in the positive Y direction so that the reservoir 28*d* is wholly or mostly outside of its bay. In this position, the reservoir 28*d* may be easily unloaded from or loaded onto the slider to allow it to be installed or replaced.

Figure 5A:
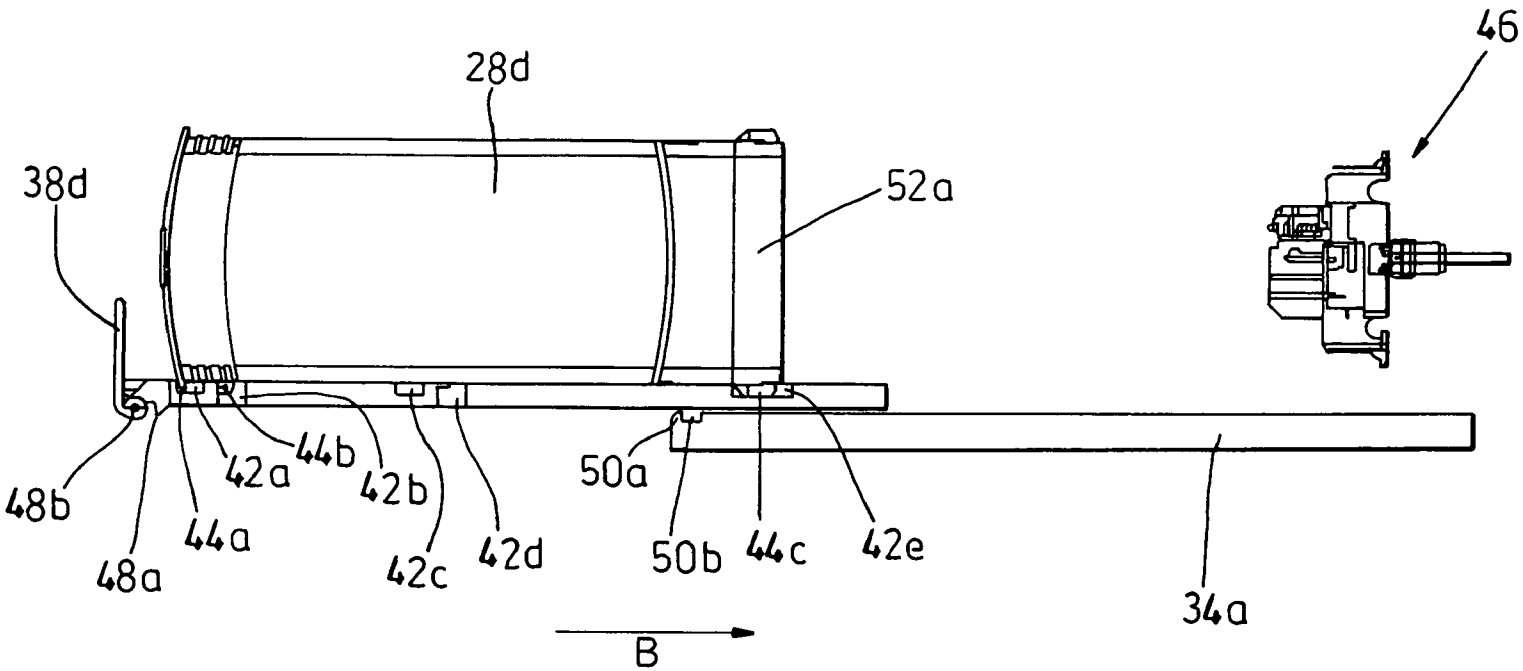
FIGS. 5*a* and 5*b* show a cross sectional view of the open slider illustrated in FIGS. 4*a* and *b*, respectively; and, FIGS. 6*a* and 6*b* show a cross sectional view of the slider and reservoirs illustrated in FIGS. 5*a* and 5*b*, respectively, but in the closed position.

FIG. 5*a* schematically illustrates a cross sectional view taken along the lines A—A in FIG. 4*a* of the slider 36*d*, the slider release tab 38*d*, the reservoir 28*d* and the lower surface 34*a* of the housing 34. As can be seen from FIG. 5*a*, the slider 36*d* has a number of recesses 42*a–e* located in its upper surface, as viewed in the figure. The lower surface of the reservoir 28*d*, as viewed in the figure, has a number of bosses or features 44*a–c*. When the reservoir 28*d* is correctly positioned on the slider 36*d*, the bosses 44*a*, 44*b* and 44*c* are located in the recesses 42*a*, 42*b* and 42*e* of the slider 36*d*, respectively. The location of the bosses 44*a–c* in the corresponding features of the slider 36*d* secures the reservoir 28*d* to the slider 36*d* in a predetermined position relative to the slider 36*d*. Thus, the reservoir connections 52*a* of reservoir 28*d'* are located at a predetermined position along the Y axis relative to the slider 36*d*.

The user may remove the reservoir 28*d* located on the slider 36*d* by lifting it up from the slider 36*d*, in the positive Z direction. Alternatively, the user may install the reservoir 28*d* so that it is correctly connected for printing simply by pushing the slider 36*d* in the direction of the arrow B shown in the figure. This may be done, in the present embodiment, by pushing the slider release tab 38. Thus, the slider 36*d* and the reservoir 28*d* move relative to the lower surface 34*a* of the housing 34, until they reach the position shown in FIG. 6*a*.

Figure 6A:
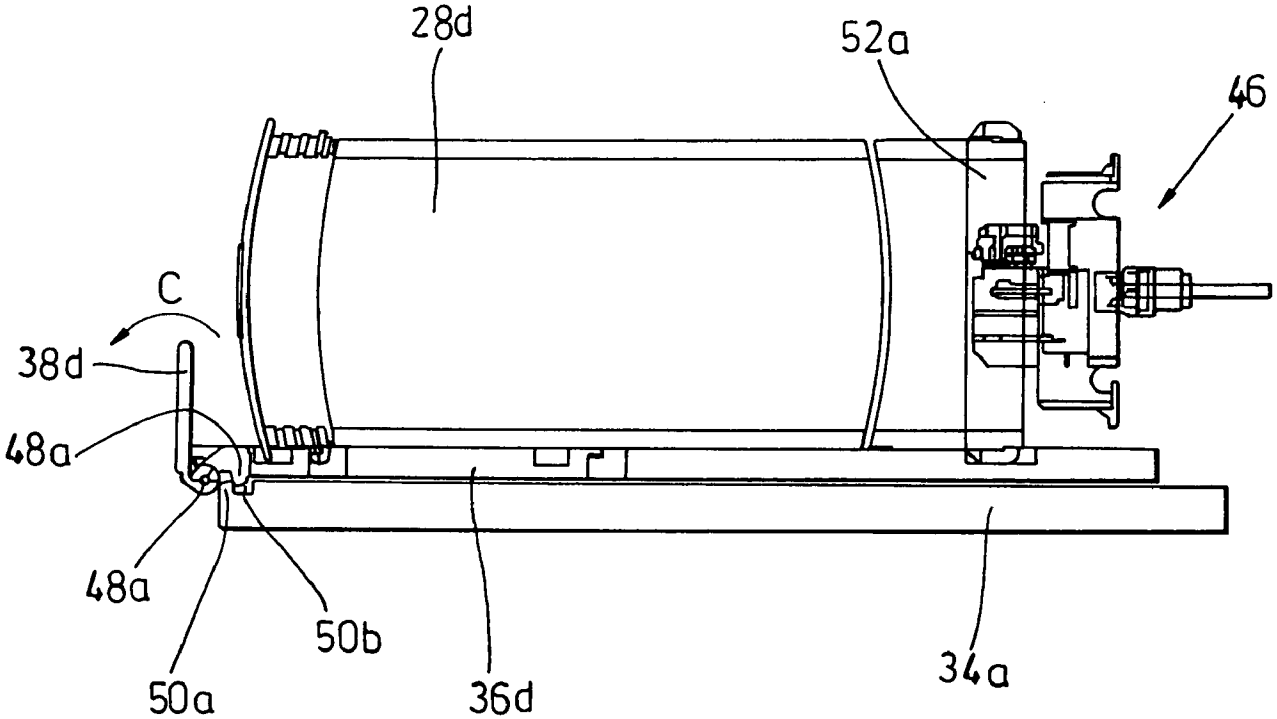

As can be seen from FIG. 6*a*, the reservoir 28*d* is now in its installed position in the adaptor unit 30. In this position, the slider 36*d* is fully retracted into the housing 34. The position of the reservoir 28*d* relative to the slider 36*d* has been maintained due to the interaction of the bosses 44*a*, 44*b* and 44*c* of the reservoir 28*d* and the recesses 42*a*, 42*b* and 42*e* of the slider 36*d*. The electrical and fluid connections required between the reservoir 28*d* and the corresponding connections 46 of the ink delivery system of the printer 10 have been made. In the present embodiment, the connections 46 of the ink delivery system of the printer are resiliently mounted in the Y axis; in this case using one or more conventional springs (not shown). This allows the force with which the user is required to push the slider 36*d* in order to make the connections between the reservoir 28*d* and the printer ink delivery system to be regulated. In this manner, it may be ensured that sufficient force is applied to make the connection, whilst limiting excess force, which might otherwise damage the system.

As can be seen from the figure, a hook 48*a* is mounted on the slider about a pivot axis 48*b*. As the slider 36*d* approaches its fully retracted position, the hook contacts a cam surface or lip 50*a* associated with the lower surface 34*a* of the housing 34. As the user continues to push the slider assembly towards the fully retracted position, the hook 48*a* rides up over the lip 50*a* against a biasing spring (not shown). As the skider continues to move in the negative Y direction, the hook, which continues to be biased downwards by the spring force as viewed in FIGS. 5*a* and 6*a*, engages with a recess 50*b* located in a surface of the lower surface 34*a* of the housing 34. When the user hears or feels this locking engagement, he intuitively understands that the reservoir 28*d* is installed. The engagement of the hook 48*a* in the recess 50*b*, then secures the slider 36*d* together with the reservoir 28*d* in the installed position against the biasing spring force of the ink delivery system connections 46. In this manner, the electrical and fluid connections between the reservoir 28*d* and the ink delivery system connections are maintained at a predetermined force even once the user releases the slider release tab 38*d*.

In the present embodiment, the slider release tab 38*d* is, like the hook 48*a*, arranged to pivot about the pivot axis 48*b*. As the slider release tab 38*d* is pulled in the direction of the positive Y axis, the slider release tab 38*d* rotates about the pivot axis 48*b* in the direction of arrow C shown in FIG. 6*a*. This has the effect of raising the hook 48*a* relative to the recess 50*b*, by virtue of a conventional camming system (not shown). Continued force applied to the slider release tab 38*d* in the direction of the positive Y axis, causes the slider assembly, which is no longer restrained by the hook 48*b*, to move in the direction of the positive Y axis. In this manner, the reservoir 28*d* is disengaged from the ink delivery system connections 46 and returned to the position shown in FIG. 5*a*. Thus, in the present embodiment, one simple control, pushing or pulling the slider release tab 38*d*, may be used to install or uninstall the reservoir 28*d*.

It will be appreciated that the high volume reservoirs may be installed or uninstalled installation from the other bays 40*a–c* in the same manner. This will therefore not be further described.

Figure 4B:
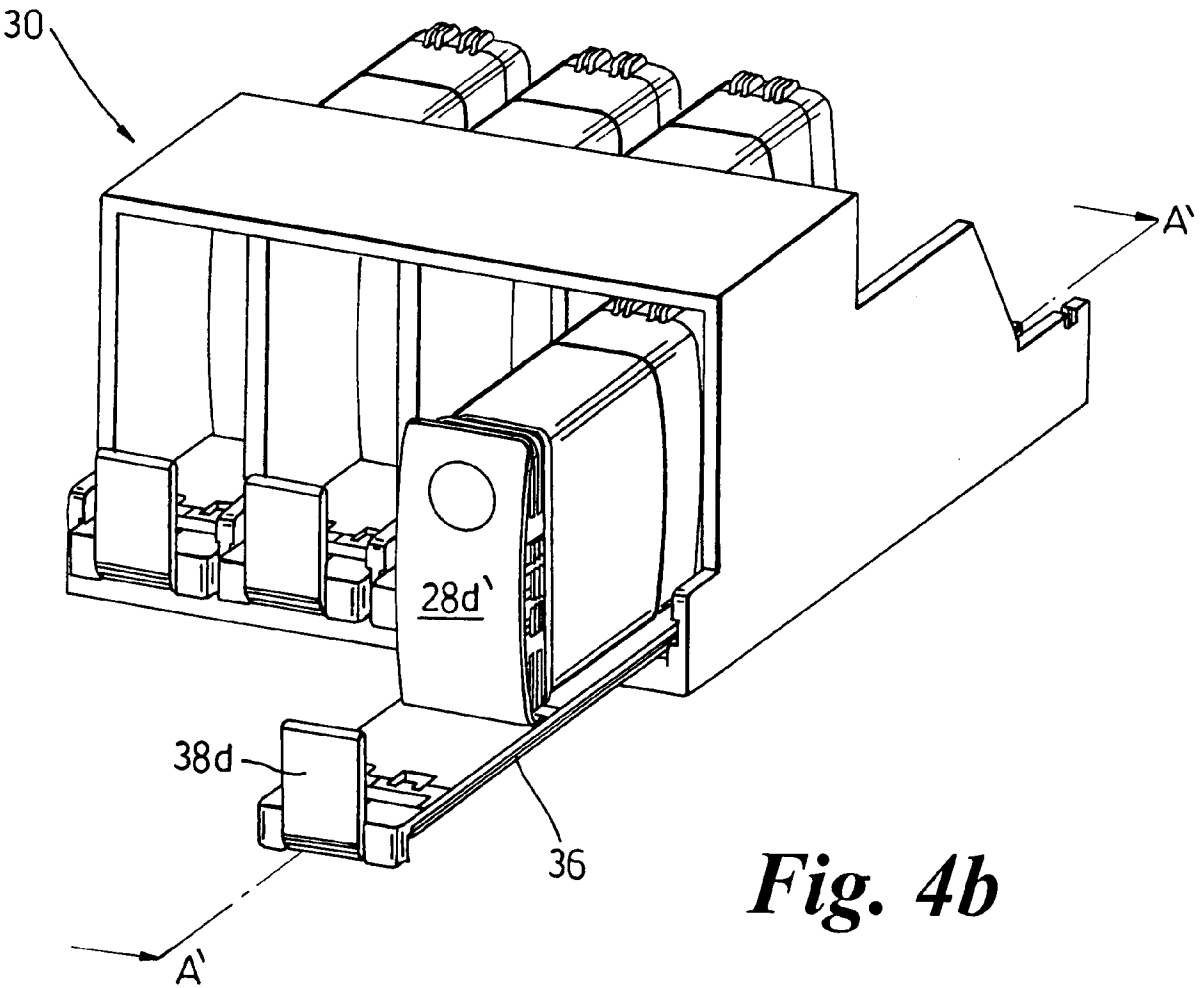
Figure 5B:
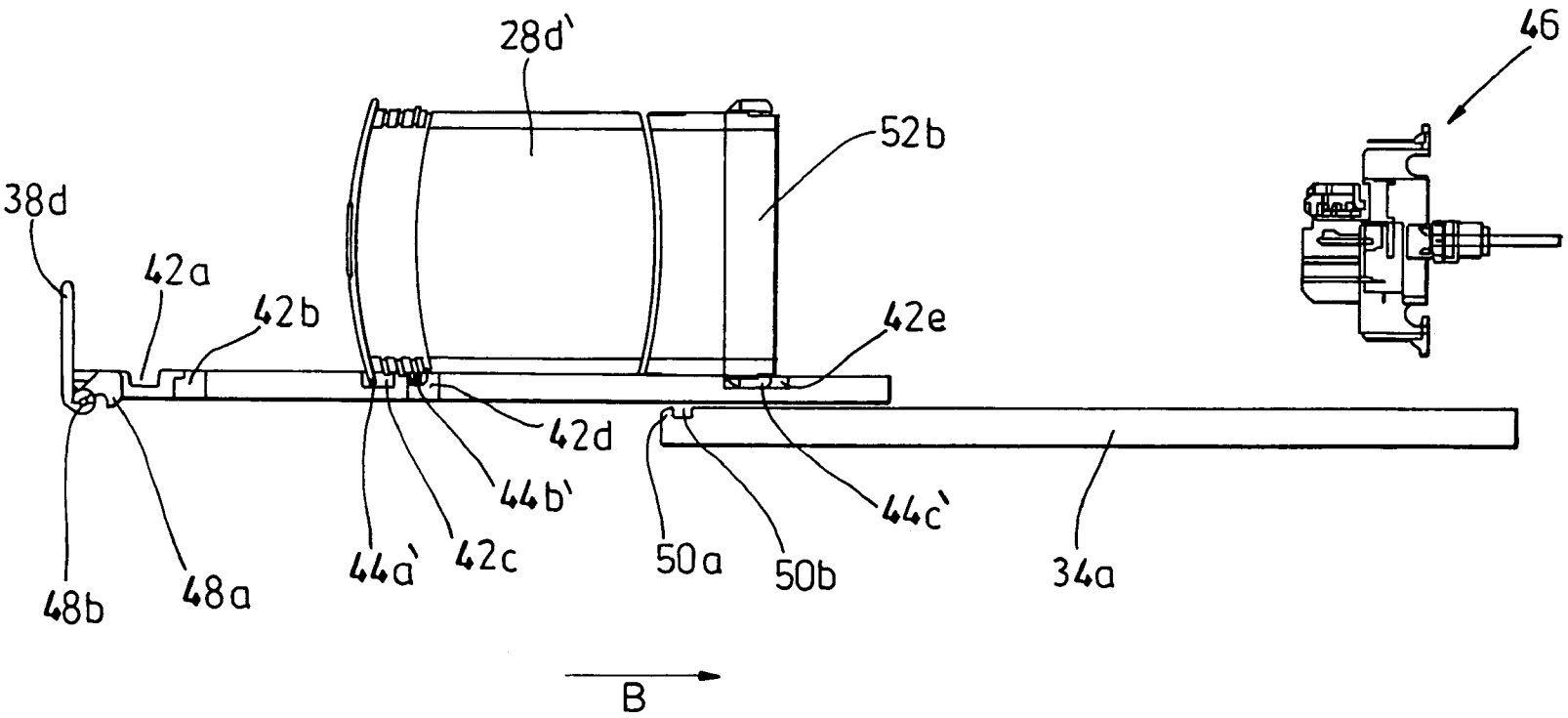

Referring now to FIGS. 4*b*, 5*b* and 6*d*, the installation and removal of a low volume reservoir 28*d*' from the bay 40*d* will now be described.

Referring now to FIG. 4*b*, a view, similar to that shown in FIG. 2*b*, of the adaptor unit 30 with low volume reservoirs is illustrated. However, in FIG. 4*b*, the slider 36*d* is illustrated in its open or extended position, with the reservoir 28*d*' correctly located on the slider 36*d*. As can be seen from the figure, however, the reservoir 28*d*' is separated from the slider release tab 38*d* by a much greater distance than was the case with a high volume cartridge 28*a–d*. Similarly, however, the reservoir 28*d*' is wholly or mostly outside of its bay when correctly located on the slider 36*d* in its extended position. In this position, the reservoir 28*d*' may be easily unloaded or loaded onto the slider to allow it to be installed or replaced.

FIG. 5*b* schematically illustrates a cross sectional view taken along the lines A'—A' in FIG. 4*b* of the slider 36*d*, the slider release tab 38*d*, the reservoir 28*d*' and the lower surface 34*a* of the housing 34. As can be seen from FIG. 5*b*, the lower surface of the reservoir 28*d*', as viewed in the figure, has a number of bosses or features 44*a'–c'*, which correspond to those features 44*a–c* of the high volume reservoir 28*d*. When the reservoir 28*d*' is correctly located on the slider 36*d*, the boss 44*c*', which is adjacent the reservoir connections 52*b*, is located in the recess 42*e* of the slider 36*d*. Thus, the reservoir connections 52*b* of reservoir 28*d*' are located in the same position along the Y axis relative to the slider 36*d* as were the reservoir connections 52*a* of reservoir 28*d*, despite the difference in the lengths in the Y axis between the high and the low volume reservoirs.

Due to the difference in length between the high volume and the low volume reservoirs, the remaining bosses 44*a*' and 44*b*' of the reservoir 28*d*' are located in different recesses to those occupied by the bosses 44*a* and 44*b* of the high volume reservoir 28*d*. As can be seen from FIG. 5*b*, the bosses 44*a*' and 44*b*' of the reservoir 28*d*' are located the recesses 42*c* and 42*d* respectively in the upper surface of the slider 36.

Figure 6B:
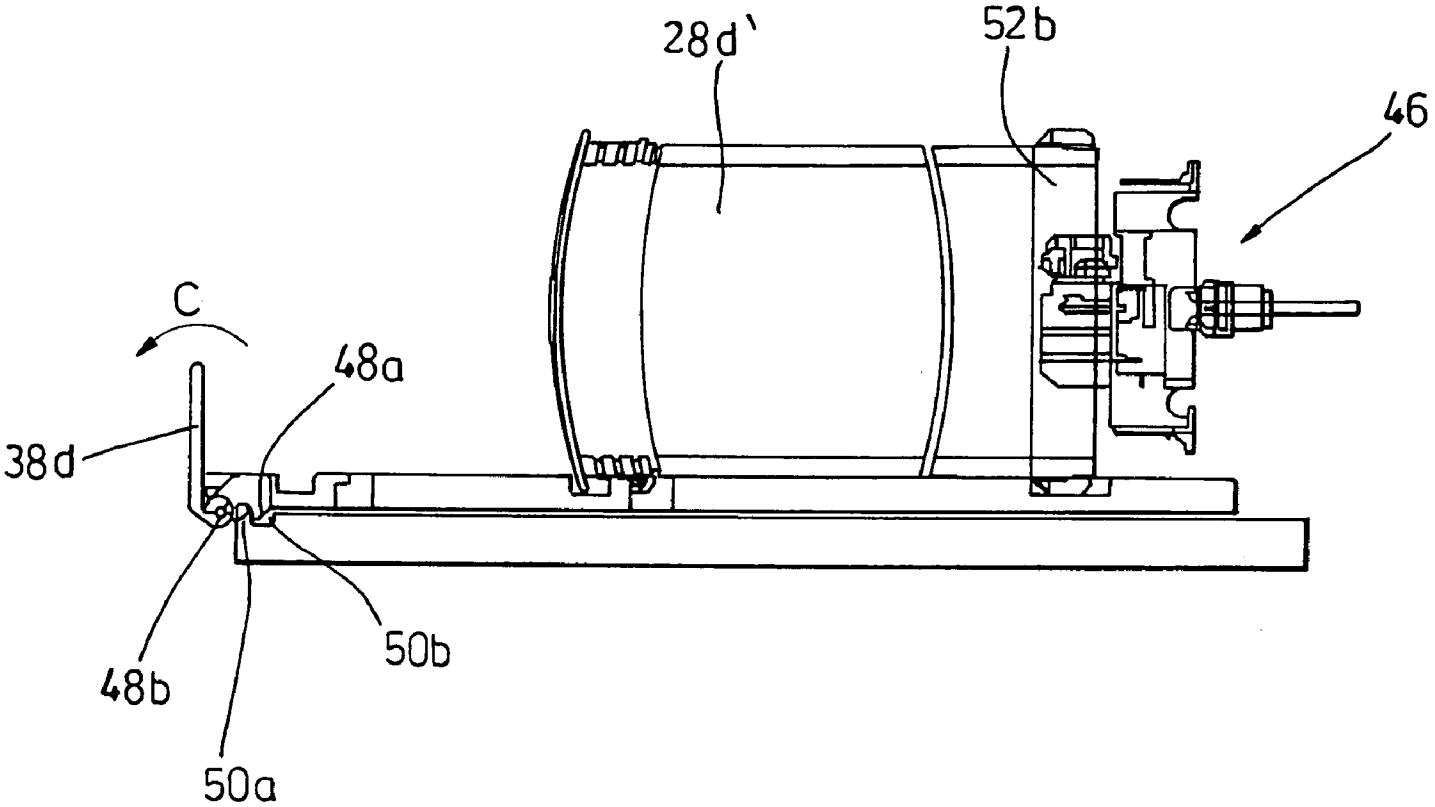

As was described above with reference to FIG. 5*a*, the user may remove the reservoir 28*d*' that is located on the slider 36*d* by lifting it up from the slider 36*d*, in the positive Z direction. Alternatively, the user may install the reservoir 28*d*' so that it is correctly connected for printing simply by pushing slider release tab 38 in the direction of the arrow B shown in the figure until the reservoir 28*d*' is correctly installed; as is illustrated in FIG. 6*b*. The user may then uninstall the reservoir 28*d*' by pulling the slider release tab 38. These processes function as described above with regard to the installation and removal of the high volume reservoir 28*d*, and so will not be described further.

As was described above, the reservoir connections 52*a* and 52*b* of the high and low volume reservoirs are located at the same position along the Y axis relative to the slider 36*d* when their respective reservoirs are correctly located on the slider 36*d*. Consequently, the force with which the user is required to push the slider 36*d* to correctly install either a high or a low volume reservoir against the spring force of the spring mounted connections 46 of the ink delivery system of the printer is the same. It will be understood that this allows a simple and reliable connection to be established in the same way for both reservoir types.

Further Embodiments

In the above embodiment numerous specific details are set forth in order to provide a thorough understanding of the present invention. It will be apparent however, to one skilled in the art, that the present invention may be practiced without limitation to these specific details. In other instances, well known methods and structures have not been described in detail so as not to unnecessarily obscure the present invention.

For example, although the above-described embodiment functions with two sizes of ink reservoir, it will be appreciated that in other embodiments a different number of reservoir sizes may be employed. This number may be three, four or indeed any reasonable number. It will be appreciated that such embodiments may require merely further recesses in the slider elements in which the bosses of the further reservoir sizes may be located.

In the above-described embodiment, certain boss/recess combinations used to locate a reservoir on a slider were common to the different reservoir sizes, whilst other boss/recess combinations were not common to the different reservoir sizes. It will however be understood that this may be varied in other embodiments of the invention. For example, in one such embodiment different reservoir sizes may exclusively use common boss/recess combinations. In another such embodiment different reservoir sizes may exclusively use non-common boss/recess combinations.

In the above-described embodiment, the high and low volume reservoirs had differing lengths but the same or similar cross sections. It will be understood however, that the present invention may also be applied with benefit to hardcopy systems in which the cross sections of reservoirs of different volumes are different.

Although the term reservoir has been used to describe ink reservoirs, the skilled reader will appreciate that other substances may be stored in such reservoirs; for example a conventional ink fixer substance.

It will be understood that in other embodiments of the invention, the number of ink reservoirs employed may differ from that described above. Any reasonable number of ink reservoirs may be employed; for example, one, two, three, or five or more.

Although in the above description the slider was arranged to move linearly between the reservoir loading position and the installed position, the skilled reader will appreciate that in practice this need not necessarily be the case. For example, the slider or other reservoir support device may instead by arranged to follow a curved path, or to rotate between these positions.

Furthermore, although in the above-described embodiment the slider was arranged to move substantially the same distance between the first and second positions when loading both the high and the low volume supplies, it will be appreciated that this may be varied in other embodiments. For example, in other embodiments the interfaces of reservoirs of different volumes may be arranged to be located at different points relative to the slider element.

It will also be understood that although the above-described embodiment was described as being an inkjet printer, the present invention may be applied with benefit to a wide range of hardcopy systems. These may include inkjet copiers for example, non-inkjet copiers, or other non-inkjet devices.

What is claimed is:

1. An adaptor for use in a hardcopy device, comprising a reservoir supporting element movable relative to the adaptor between first and second positions, the supporting element being arranged to receive a reservoir when in the first position, and being further arranged, when moved to the second position, to bring an interface associated with the reservoir into a predetermined position relative to the adaptor, wherein the supporting element is arranged to receive a reservoir such that an interface associated with the reservoir is located in a predetermined position relative to the supporting element, wherein the supporting element is arranged to support any type of a set of reservoir types, each reservoir type having a different volume, wherein the supporting element comprises one or more features, arranged in use to interact with one or more corresponding features of a reservoir, to maintain the reservoir substantially stationary relative to the supporting element, and wherein the one or more features comprise at least first and second sets located distant to the predetermined position of the reservoir interface relative to the adaptor, the first and second sets of features each being arranged to locate a different reservoir type.

2. An adaptor according to claim 1 wherein the one or more features comprise a third set located adjacent to the predetermined position of the reservoir interface relative to the adaptor, the third set of features being arranged to locate a plurality of reservoir types.

3. An adaptor according to claim 1 wherein the one or more features comprise at least one of bosses and recesses.

4. An adaptor according to claim 1, further comprising at least one restraint adapted in use to oppose the expansion of the reservoir.

5. An adaptor according to claim 4, wherein the at least one restraint is located such that it is adjacent a reservoir when the support element is located in the second position but not the first position.

6. An adaptor according to claim 5, wherein the at least one restraint comprises first and second surfaces arranged to be located on opposing sides of the reservoir.

7. An adaptor according to claim 1, wherein the support element is arranged to move substantially linearly between the first and second positions.

8. An adaptor according to claim 7, wherein the support element is arranged to slide between the first and second positions on a support surface associated with the adaptor.

9. An adaptor according to claim 8, wherein the support element is arranged to be moved manually between the first and second positions.

10. A hardcopy device comprising an ink reservoir adaptor, the adaptor comprising a reservoir supporting element movable relative to the adaptor between first and second positions, the supporting element being arranged in the first position to receive a reservoir such that an interface associated with the reservoir is located in a predetermined position relative to the supporting element, the supporting element being further arranged, when moved to the second position, to connect the interface with a corresponding interface associated with the devices, wherein the supporting element is arranged to receive a reservoir such that an interface associated with the reservoir is located in a predetermined position relative to the supporting element, wherein the supporting element is arranged to support any type of a set of reservoir types, each reservoir type having a different volume, wherein the supporting element comprises one or more features, arranged in use to interact with one or more corresponding feature of a reservoir, to maintain the reservoir substantially stationary relative to the supporting element, and wherein the one or more features comprise at least first and second sets located distant to the predetermined position of the reservoir interface relative to the adaptor, the first and second sets of features each being arranged to locate a different reservoir type.

11. A device according to claim 10, wherein the interface associated with the device is resiliently mounted relative to the interface associated with the reservoir, so as to regulate a force between the two interfaces when the supporting element is located in the second position.

12. An inkjet device according to claim 10.

13. An inkjet device according to claim 10, wherein the one or more features comprise a third set located adjacent to the predetermined position of the reservoir interface relative to the adaptor, the third set of features being arranged to locate a plurality of reservoir types.

* * * * *